US006510294B1

(12) United States Patent
Hakamada

(10) Patent No.: US 6,510,294 B1
(45) Date of Patent: Jan. 21, 2003

(54) IMAGE FORMING APPARATUS AND ITS CONTROLLING METHOD

(75) Inventor: Susumu Hakamada, Kawasaki (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/948,637

(22) Filed: Sep. 10, 2001

(51) Int. Cl.[7] ..... G03G 15/08; G03G 15/00
(52) U.S. Cl. ..... 399/58; 399/27; 399/44
(58) Field of Search ..... 399/94, 97, 51, 399/53, 58, 59, 27, 29, 44; 347/129, 128, 140, 132

(56) References Cited

U.S. PATENT DOCUMENTS 5,708,917 A * 1/1998 Kawai et al. ..... 399/58
5,778,279 A * 7/1998 Kawai et al. ..... 399/27
5,920,748 A * 7/1999 Kawai et al. ..... 399/59
6,175,698 B1 * 1/2001 Scheuer et al. ..... 399/27

FOREIGN PATENT DOCUMENTS

JP 11-174909 7/1999

* cited by examiner

*Primary Examiner*—Susan S. Y. Lee
(74) *Attorney, Agent, or Firm*—Foley & Lardner

(57) ABSTRACT

The present invention is directed to an image forming apparatus and its control method, which apparatus having a laser pulse arithmetic circuit for counting a time period in which a laser pulse signal is in an ON state, a temperature sensor for monitoring temperature in a developing unit and output temperature data, a humidity sensor for monitoring humidity in the developing unit and output humidity data, a control section for calculating consumption of toner in the developing unit on the basis of a counted value of the laser pulse arithmetic circuit, temperature data obtained from the temperature sensor and humidity data obtained from the humidity sensor, thereby calculating a toner supply time period to maintain a constant toner amount in the developing unit, and a toner supply section for supplying toner into the developing unit on the basis of the toner supply time period calculated by the control section.

10 Claims, 4 Drawing Sheets

IMAGE FORMING APPARATUS AND ITS CONTROLLING METHOD

BACKGROUND OF THE INVENTION

The present invention relates to an image forming apparatus such as a full-color copy machine or a color printer, and its control method (in particular, toner supply control).

In conventional xerographic image forming apparatuses using a laser, a dedicated sensor for sensing a toner residual amount in a developing unit is provided to maintain a constant amount of toner in the unit. This type of sensor is, for example, a magnetic sensor or an adhesion strength sensor, etc.

Japanese Patent Application KOKAI Publication No. 11-174909 discloses a technique for easily and accurately estimating the consumption of toner. This technique is characterized in that a correction amount is determined on the basis of an image type, a toner residual amount and humidity, and a time period in which a toner supply motor is kept in the ON state is calculated using a predetermined formula.

However, in the above case, a developing unit provided with a dedicated sensor inevitably increases the cost. In other words, the technique does not sufficiently satisfy the requirements of downsizing and cost reduction.

Even at present, there is a demand for accurate and easy estimation of toner supply timing, executed while satisfying the requirements of downsizing and cost reduction.

BRIEF SUMMARY OF THE INVENTION

The present invention has been developed in light of the above, and aims to easily and accurately estimate toner supply timing by counting laser pulses when forming an image, calculating the consumption of toner in a developing unit on the basis of the counting result, and calculating a time period in which toner is to be supplied into the developing unit.

Additionally, the present invention aims to more accurately estimate toner supply timing by clearing, when a toner cartridge has been exchanged, the total sum of pulses of a laser pulse signal, then summing up pulses of the laser pulse signal each time an image is formed, thereby calculating the amount of toner in the toner cartridge.

To satisfy the aim, an image forming apparatus according to the invention comprises: a laser pulse arithmetic circuit configured to count a time period in which a laser pulse signal is in an ON state; a temperature sensor configured to monitor temperature in a developing unit and output temperature data; a humidity sensor configured to monitor humidity in the developing unit and output humidity data; a control section configured to calculate consumption of toner in the developing unit on the basis of a counted value of the laser pulse arithmetic circuit, temperature data obtained from the temperature sensor and humidity data obtained from the humidity sensor, thereby calculating a toner supply time period to maintain a constant toner amount in the developing unit; and a toner supply section configured to supply toner into the developing unit on the basis of the toner supply time period calculated by the control section.

Further, an image forming apparatus according to the invention, comprises: a scanner section configured to read image information on a to-be-copied object and create an image signal; an image forming section configured to form an image corresponding to the image signal output from the scanner section; a laser pulse arithmetic circuit configured to count a time period in which a laser pulse signal is in an ON state; a temperature sensor configured to monitor temperature in a developing unit and output temperature data; a humidity sensor configured to monitor humidity in the developing unit and output humidity data; a control section configured to calculate consumption of toner in the developing unit on the basis of a counted value of the laser pulse arithmetic circuit, temperature data obtained from the temperature sensor and humidity data obtained from the humidity sensor, thereby calculating a toner supply time period to maintain a constant toner amount in the developing unit, and clearing the ON-state time period of the laser pulse signal counted by the laser pulse arithmetic circuit when a toner cartridge has been exchanged; an F-ROM configured to store data related to the consumption of toner; a toner supply section configured to supply toner into the developing unit on the basis of the toner supply time period calculated by the control section; and an operation panel configured to display a message that the toner cartridge should be exchanged.

Furthermore, a control method for an image forming apparatus according to the invention comprises the steps of: counting a time period in which a laser pulse signal is in an ON state; monitoring a temperature in a developing unit and outputting temperature data; monitoring humidity in a developing unit and outputting humidity data; calculating consumption of toner in the developing unit on the basis of the counted value, the temperature data and the humidity data, thereby calculating a toner supply time period to maintain a constant toner amount in the developing unit; and supplying toner into the developing unit on the basis of the calculated toner supply time period.

Yet further, a control method for an image forming apparatus according to the invention comprises the steps of: reading image information on a to-be-copied object and creating an image signal, using a scanner section; forming an image corresponding to the image signal output from the scanner section, using an image forming section; counting a time period in which a laser pulse signal is in an ON state, using a laser pulse arithmetic circuit; monitoring a temperature in a developing unit and outputting temperature data, using a temperature sensor; monitoring humidity in a developing unit and outputting humidity data, using a humidity sensor; calculating consumption of toner in the developing unit on the basis of the counted value of the laser pulse arithmetic circuit, the temperature data of the temperature sensor, and the humidity data of the humidity sensor, thereby calculating a toner supply time period to maintain a constant toner amount in the developing unit, and clearing the counted ON state time period of the laser pulse signal when a toner cartridge has been exchanged, using a control section; storing data related to the consumption of toner in an F-ROM; supplying toner into the developing unit on the basis of the calculated toner supply time period, using a toner supply section; and displaying a message that the toner cartridge should be exchanged, using an operation panel.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will be described with reference to the accompanying drawings.

Figure 1:
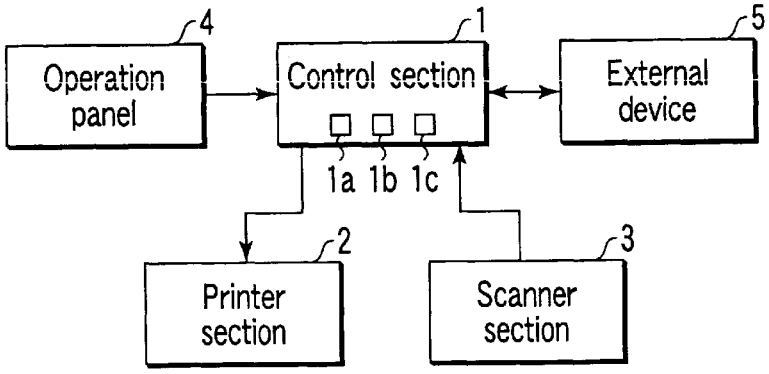
FIG. 1 is a block diagram illustrating an image forming apparatus according to an embodiment of the invention.

Referring first to FIG. 1, an image forming apparatus according to the embodiment will be described. As shown, the image forming apparatus mainly comprises a control section 1, a printer section 2, a scanner section 3, an operation panel 4 and an external device 5.

The control section 1 controls the entire image forming apparatus.

The control section 1 at least includes a CPU 1*a*, an F-ROM 1*b* and a laser pulse arithmetic circuit 1*c*. The control section 1 also includes a ROM, a RAM, an NVRAM, a common RAM, an image processing section, a page memory control section, a page memory, a printer controller and a printer font ROM, which are not shown.

The scanner section 3 reads image information on a to-be-copied object (not shown) in the form of light and dark, thereby creating an image signal. The scanner section 3 includes a scanner CPU, a ROM, a RAM and an image correcting section, etc., which are not shown.

The operation panel 4 includes a liquid crystal display section, various operation keys and a panel CPU connected to them, which are not shown, and is configured to perform various setup operations and a display operation.

The printer section 2 prints out an image corresponding to an image signal supplied from the scanner section 3 or the external device 5.

Figure 2:
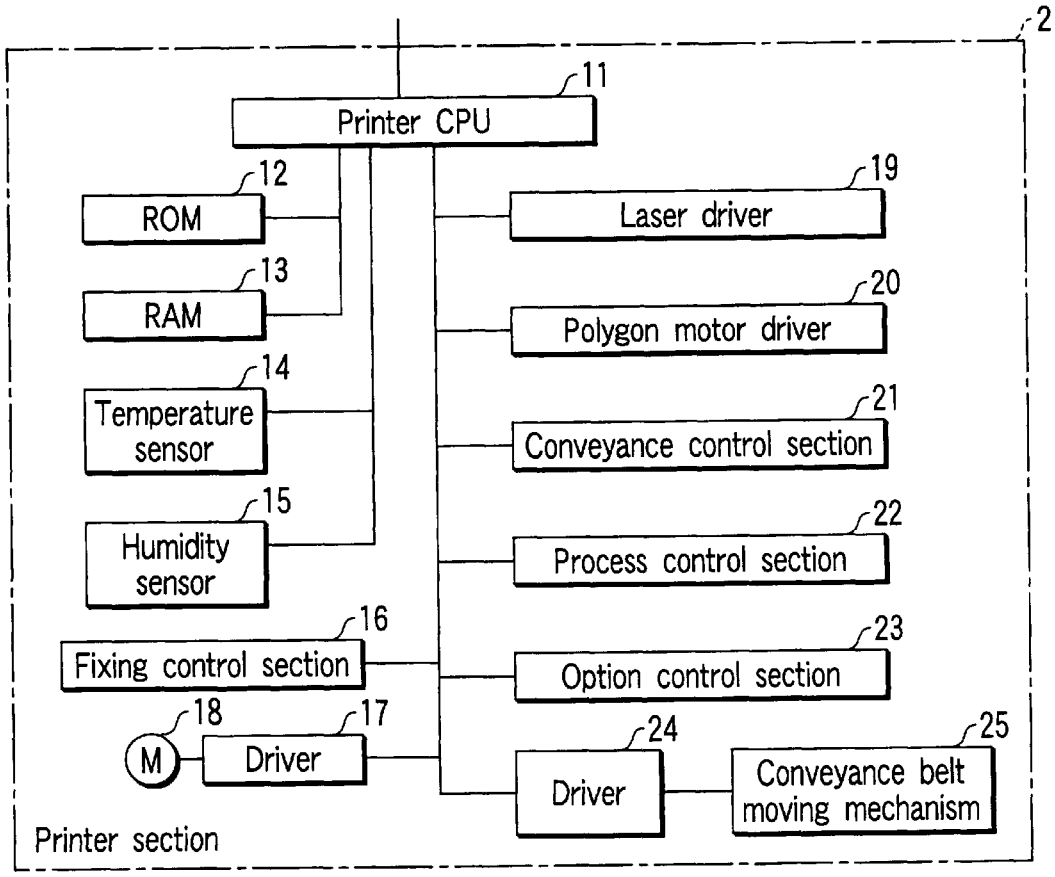
FIG. 2 is a block diagram illustrating, in detail, a printer section 2 as a characterizing section in the image forming apparatus of the embodiment.

Referring then to FIG. 2, a detailed description will be given of the configuration and function of the printer section 2 as a characterizing section of the image forming apparatus of the embodiment.

As shown in FIG. 2, the printer section 2 at least includes a printer CPU 11, a ROM 12, a RAM 13, a temperature sensor 14, a humidity sensor 15, a fixing control section 16, a driver 17, a toner supply motor 18, a laser driver 19, a polygonal motor driver 20, a conveyance control section 21, a process control section 22, an option control section 23, a driver 24 and a conveyance belt moving mechanism 25.

In the above-described structure, the printer CPU 11 controls the entire printer section 2. The ROM 12 stores, for example, a control program. The RAM 13 stores various types of data items. The laser driver 19 drives a semiconductor laser oscillator. The polygon motor driver 20 drives a polygon motor incorporated in an exposure unit (not shown). The conveyance control section 21 controls conveyance of paper sheets by a conveyance mechanism (not shown).

The process control section 22 controls charging, developing and transfer processes executed by a charger unit, a developing roller and a transfer unit, respectively, which are not shown. The fixing control section 16 controls a fixing unit (not shown). The process control section 22 and the fixing control section 16 create an image forming section.

Further, the option control section 23 controls an option. The driver 17 drives the toner supply motor 18. The driver 24 drives the conveyance belt moving mechanism 25.

The temperature sensor 14 and the humidity sensor 15 are provided in a developing unit for sensing temperature and humidity, respectively, and outputting the sensing results to the control section 1.

Figure 3:
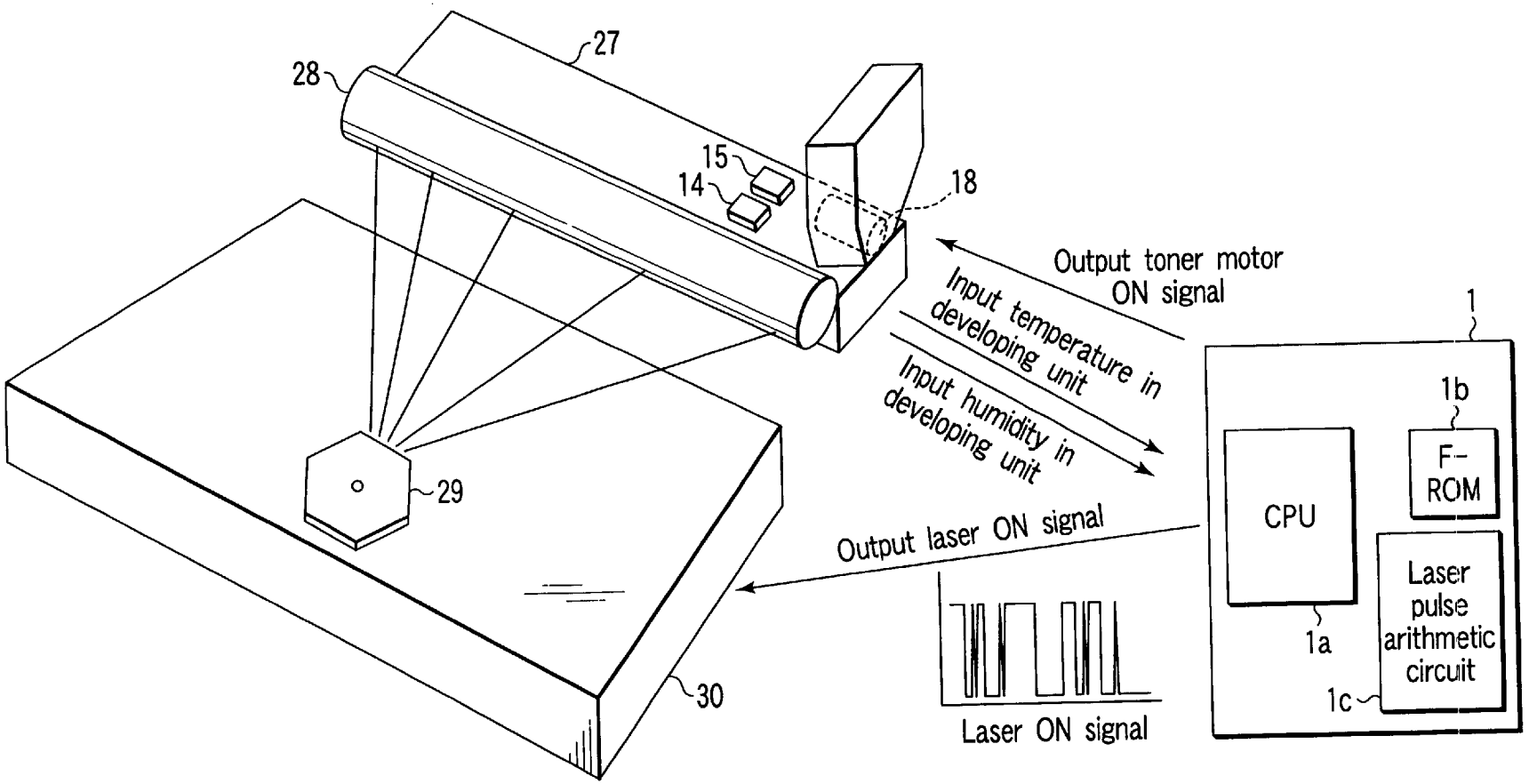
FIG. 3 is a view useful in explaining a characterizing section extracted from the image forming apparatus of the embodiment.

Referring now to FIG. 3, a description will be given of a charactering section extracted from the image forming apparatus of the embodiment.

As shown in FIG. 3, the control section 1 comprises the CPU 1*a*, the F-ROM 1*b* and the laser pulse arithmetic circuit 1*c*.

A developing unit 27 is provided with the temperature sensor 14, the humidity sensor 15, a toner cartridge 26 and the toner supply motor 18.

In addition to the above, the image forming apparatus is also provided with a laser optical system 30 that includes a photosensitive drum 28 and a polygon mirror 29. The apparatus of the invention significantly differs from the prior art in that the former comprises the laser pulse arithmetic circuit 1*c*. Instead, a toner residual amount sensor provided in the developing unit of the prior art is omitted.

In the above-described configuration, the surface of the photosensitive drum 28 is uniformly charged. The laser optical system 30 emits, to the photosensitive drum 28, a laser beam corresponding to a to-be-printed character or symbol, thereby forming an electrostatic latent image.

Subsequently, the developing unit 27 adheres toner to an electrostatic latent image portion on the photosensitive drum 28, the charge of which is varied by the laser beam. The adhered toner is transferred onto a record medium. After that, the image is fixed by heat and pressure, and the static electricity on the photosensitive drum 28 is removed.

Figure 4:
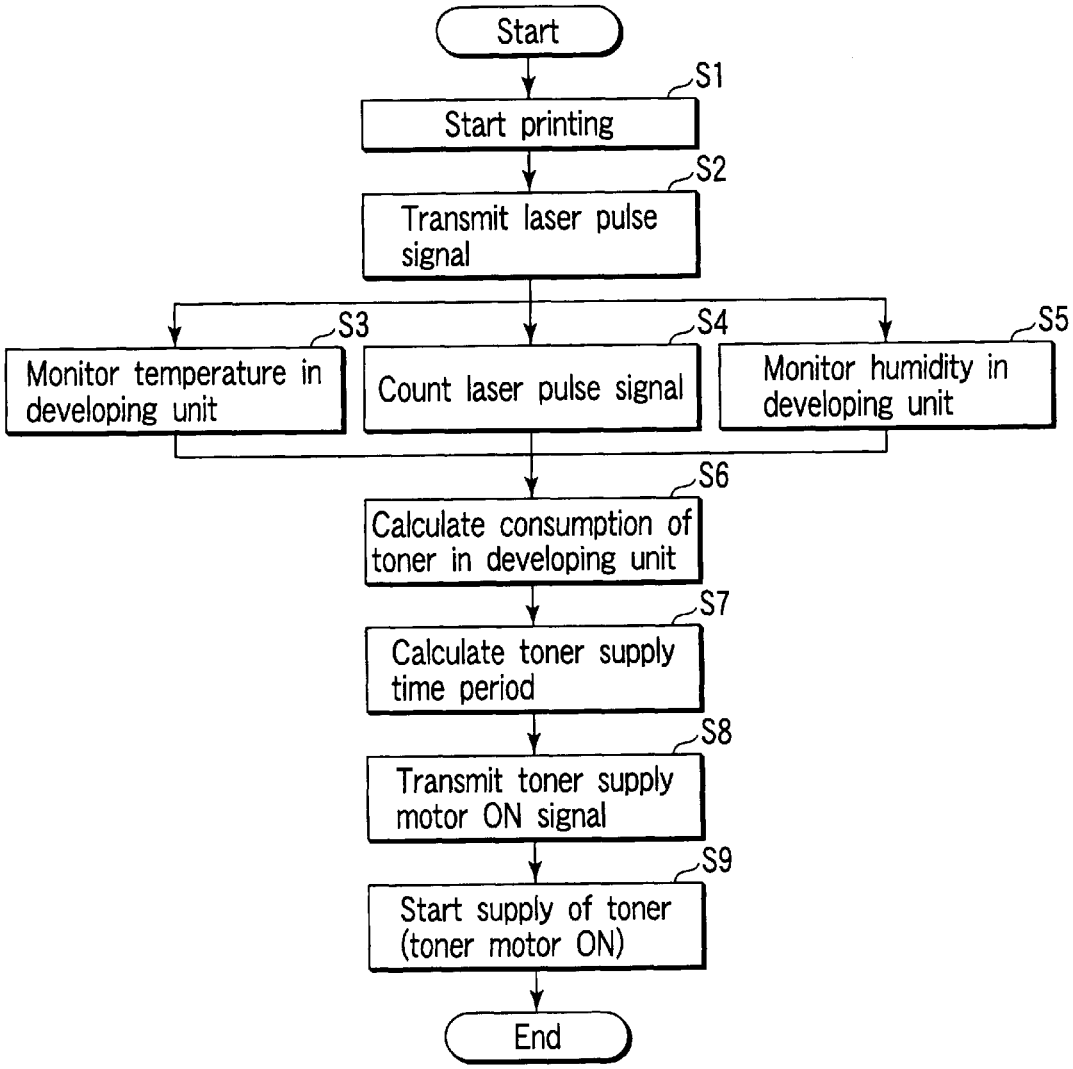
FIG. 4 is a flowchart useful in explaining, in detail, toner supply control executed in the image forming apparatus of the embodiment.

Referring then to the flowchart of FIG. 4, a more detailed description will be given of toner supply control performed by the image forming apparatus according to the embodiment of the invention.

When a printing operation has been started by, for example, operating the operation panel 4 (step S1), the laser pulse arithmetic circuit 1*c* of the control section 1 outputs a laser pulse signal to the laser optical system 30 (step S2).

At this time, the control section 1 counts, using the laser pulse arithmetic circuit 1*c*, a time period in which the laser pulse signal is kept in the ON state (step S4). At the same time, the control section monitors the temperature in the developing unit 27, using the temperature sensor 14 (step S3), and monitors the humidity in the developing unit 27, using the humidity sensor 15 (step S4).

The control section 1 calculates the consumption of toner in the developing unit 27 on the basis of three data items, i.e. the counted time period of the ON state of the laser pulse signal, temperature data and humidity data (step S6), thereby calculating a toner supply time period necessary to maintain a constant amount of toner in the developing unit 27 (step S7).

Thus, an ON signal is sent to the toner supply motor 18 to operate it for the calculated time period (step S8), thereby supplying toner into the developing unit 7 to maintain a constant amount of toner (step S9).

Figure 5:
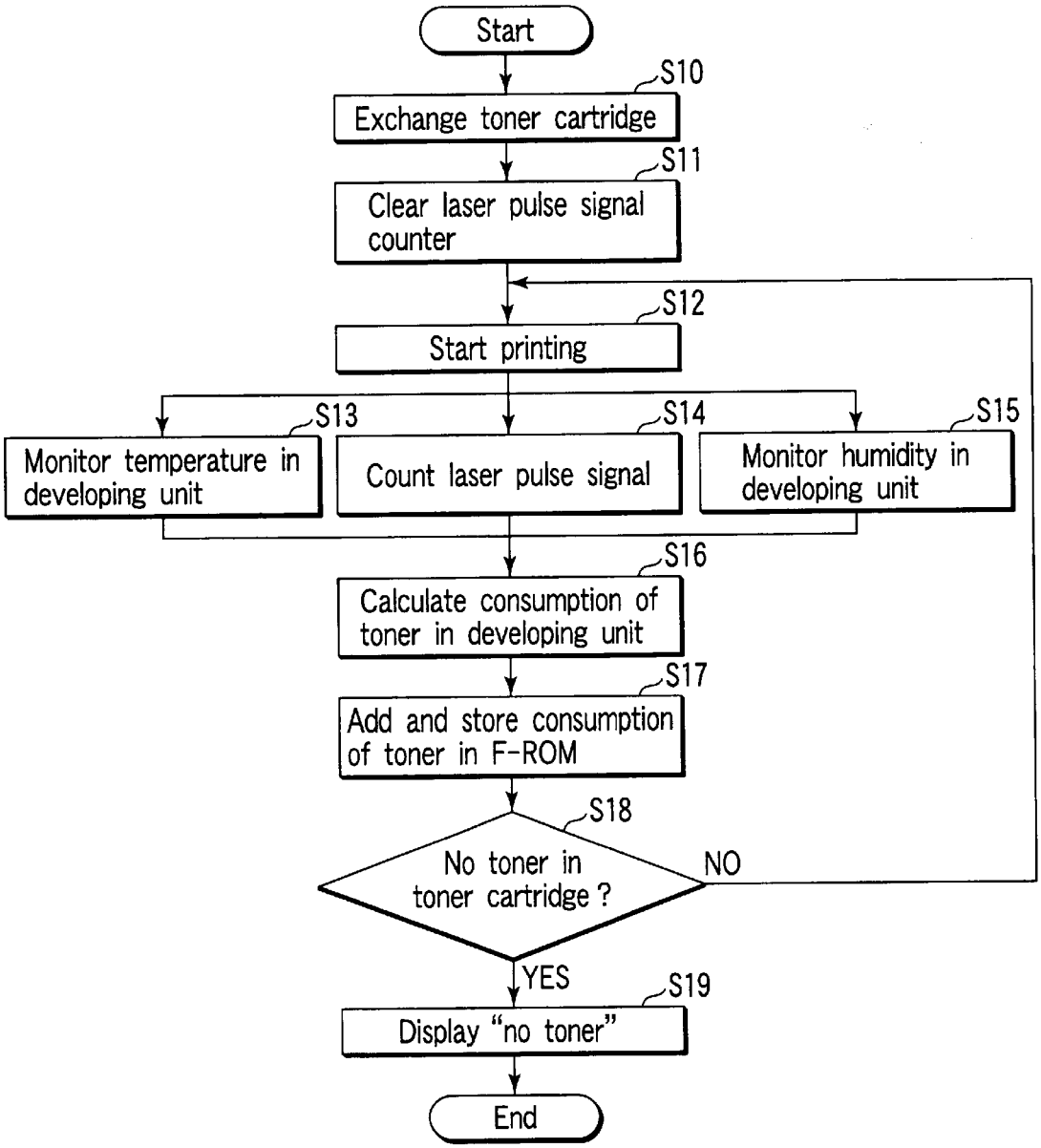
FIG. 5 is a flowchart useful in explaining, in detail, detection as to whether a toner carriage 26 has run out of toner, which is executed in the image forming apparatus of the embodiment.

Referring then to the flowchart of FIG. 5, a more detailed description will be given of a detection process, which is executed by the image forming apparatus of the embodiment to determine whether the toner cartridge 26 has run out of toner.

When the user has exchanged the toner cartridge 26 with a new one (step S10), the control section 1 clears the counted value of the laser pulse signal counted by the laser pulse arithmetic circuit 1*c* (step S11).

Thereafter, each time the printing operation is executed, the consumption of toner in the developing unit 27 is calculated and accumulated on the basis of the counted value (ON time period) of the laser pulse signal counted by the laser pulse arithmetic circuit 1*c*, and the outputs of the temperature sensor 14 and the humidity sensor 15 located in the developing unit 27 (steps S13–S16).

This data is stored in, for example, the F-ROM 1*b* so as to be kept even if the supply of power is interrupted (step S17).

The aforementioned operations are repeated until the toner consumption becomes identical to the amount of toner in the toner cartridge 26. If they become identical to each other, a message that the cartridge has run out of toner is displayed on the operation panel 4 (steps S18 and S19).

By virtue of the above-described process, the amount of toner in the developing unit 27 can be maintained constant and also, the toner runout state can be detected, simply by counting the laser pulse signal.

As described above, in the present invention, the consumption of toner in the developing unit 27 is calculated on the basis of the laser pulse signal counting result of the laser pulse arithmetic circuit 1*c* of the control section 1. Specifically, the laser pulse signal is counted when forming an image, thereby calculating the consumption of toner in the developing unit 27 on the basis of the counting result, calculating a time period in which toner is supplied into the developing unit 27, and supplying toner by operating the toner supply motor 18 to keep a constant amount of toner in the developing unit 27.

Furthermore, when the toner cartridge 26 has been exchanged with a new one, the total counted value of the laser pulse signal is cleared, and after that, pulses of a laser pulse signal are summed each time an image is formed, thereby calculating the amount of toner in the toner cartridge 26 from the total sum, and appropriately displaying a message that the toner cartridge 26 should be exchanged.

At the same time, the temperature and humidity in the developing unit 27 are monitored using the temperature sensor 14 and the humidity sensor 15. On the basis of the three data items, the consumption of toner in the developing unit 27 is calculated, and a time period in which toner is supplied is calculated so as to maintain a constant amount of toner in the developing unit 27.

As a result, the toner supply motor 18 is operated for the calculated time period to supply toner into the developing unit 27 so as to maintain a constant amount of toner therein.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus comprising:

a laser pulse arithmetic circuit configured to count a time period in which a laser pulse signal is in an ON state;

a temperature sensor configured to monitor temperature in a developing unit and output temperature data;

a humidity sensor configured to monitor humidity in the developing unit and output humidity data;

a control section configured to calculate consumption of toner in the developing unit on the basis of a counted value of the laser pulse arithmetic circuit, temperature data obtained from the temperature sensor and humidity data obtained from the humidity sensor, thereby calculating a toner supply time period to maintain a constant toner amount in the developing unit; and a toner supply section configured to supply toner into the developing unit on the basis of the toner supply time period calculated by the control section.

2. The image forming apparatus according to claim 1, wherein when a toner cartridge has been exchanged, the control section clears the ON state time period of the laser pulse signal counted by the laser pulse arithmetic circuit.

3. The image forming apparatus according to claim 1, further comprising an F-ROM that stores data related to the consumption of toner.

4. The image forming apparatus according to claim 1, further comprising an operation panel that displays a message that a toner cartridge should be exchanged.

5. An image forming apparatus comprising:

a scanner section configured to read image information on a to-be-copied object and create an image signal;

an image forming section configured to form an image corresponding to the image signal output from the scanner section;

a laser pulse arithmetic circuit configured to count a time period in which a laser pulse signal is in an ON state;

a temperature sensor configured to monitor temperature in a developing unit and output temperature data;

a humidity sensor configured to monitor humidity in the developing unit and output humidity data;

a control section configured to calculate consumption of toner in the developing unit on the basis of a counted value of the laser pulse arithmetic circuit, temperature data obtained from the temperature sensor and humidity data obtained from the humidity sensor, thereby calculating a toner supply time period to maintain a constant toner amount in the developing unit, and clearing the ON-state time period of the laser pulse signal counted by the laser pulse arithmetic circuit when a toner cartridge has been exchanged;

an F-ROM configured to store data related to the consumption of toner;

a toner supply section configured to supply toner into the developing unit on the basis of the toner supply time period calculated by the control section; and an operation panel configured to display a message that the toner cartridge should be exchanged.

6. A control method for an image forming apparatus, comprising the steps of:

counting a time period in which a laser pulse signal is in an ON state;

monitoring a temperature in a developing unit and outputting temperature data;

monitoring humidity in the developing unit and outputting humidity data;

calculating consumption of toner in the developing unit on the basis of the counted value, the temperature data and the humidity data, thereby calculating a toner supply time period to maintain a constant toner amount in the developing unit; and supplying toner into the developing unit on the basis of the calculated toner supply time period.

7. The control method for the image forming apparatus according to claim 6, further comprising the step of clearing the counted ON state time period of the laser pulse signal when a toner cartridge has been exchanged.

8. The control method for the image forming apparatus according to claim 6, further comprising the step of storing the consumption of toner in an F-ROM.

9. The control method for the image forming apparatus according to claim 6, further comprising the step of displaying a message that a toner cartridge should be exchanged.

10. A control method for an image forming apparatus, comprising the steps of:

reading image information on a to-be-copied object and creating an image signal, using a scanner section;

forming an image corresponding to the image signal output from the scanner section, using an image forming section;

counting a time period in which a laser pulse signal is in an ON state, using a laser pulse arithmetic circuit;

monitoring a temperature in a developing unit and outputting temperature data, using a temperature sensor;

monitoring humidity in the developing unit and outputting humidity data, using a humidity sensor;

calculating consumption of toner in the developing unit on the basis of the counted value of the laser pulse arithmetic circuit, the temperature data of the temperature sensor, and the humidity data of the humidity sensor, thereby calculating a toner supply time period to maintain a constant toner amount in the developing unit, and clearing the counted ON state time period of the laser pulse signal when a toner cartridge has been exchanged, using a control section;

storing data related to the consumption of toner in an F-ROM;

supplying toner into the developing unit on the basis of the calculated toner supply time period, using a toner supply section; and displaying a message that the toner cartridge should be exchanged, using an operation panel.

* * * * *